US007926402B2

(12) United States Patent
Pikus et al.

(10) Patent No.: US 7,926,402 B2
(45) Date of Patent: Apr. 19, 2011

(54) METHOD AND APPARATUS FOR MUNITION TIMING AND MUNITIONS INCORPORATING SAME

(75) Inventors: Eugene C. Pikus, Ham Lake, MN (US); David P. Erdmann, Hopkins, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 736 days.

(21) Appl. No.: 11/564,714

(22) Filed: Nov. 29, 2006

(65) Prior Publication Data

US 2008/0121131 A1 May 29, 2008

(51) Int. Cl.
*F42C 17/00* (2006.01)

(52) U.S. Cl. ..... 89/6.5; 89/6; 102/276; 102/215

(58) Field of Classification Search ..... 89/6, 6.5; 102/215, 206, 228, 232, 238, 248, 255, 257, 102/264, 266, 268, 276
See application file for complete search history.

(56) References Cited

U.S. PATENT DOCUMENTS 3,714,898 A * 2/1973 Ziemba ..... 102/215
3,739,726 A * 6/1973 Pintell ..... 102/215
3,760,732 A * 9/1973 Schuster et al. ..... 102/215
3,777,665 A * 12/1973 Ziemba ..... 102/215
3,961,320 A 6/1976 Erdmann et al.
4,022,102 A * 5/1977 Ettel ..... 89/6.5
4,052,595 A 10/1977 Erdmann et al.
4,144,815 A * 3/1979 Cumming et al. ..... 102/214
4,168,663 A * 9/1979 Kohler ..... 102/214
4,283,989 A * 8/1981 Toulios et al. ..... 89/6.5
4,495,851 A * 1/1985 Koerner et al. ..... 89/6.5
4,580,497 A 4/1986 Erdmann et al.
4,580,498 A * 4/1986 Abt et al. ..... 102/215
4,664,013 A * 5/1987 Wegner et al. ..... 89/6.5
4,674,047 A * 6/1987 Tyler et al. ..... 89/28.05
4,862,785 A * 9/1989 Ettel et al. ..... 89/6.5
5,241,892 A * 9/1993 Ousterhout ..... 89/6.5
5,343,795 A * 9/1994 Ziemba et al. ..... 89/6.5
5,467,940 A * 11/1995 Steuer ..... 102/384
5,497,704 A * 3/1996 Kurschner et al. ..... 102/264
5,585,592 A * 12/1996 Stearns et al. ..... 102/233
5,705,766 A * 1/1998 Farace et al. ..... 102/215
5,787,785 A * 8/1998 Muenzel et al. ..... 89/6.5
5,914,459 A 6/1999 Teske et al.
5,942,714 A * 8/1999 Oberlin et al. ..... 89/6.5
6,176,168 B1 * 1/2001 Keil et al. ..... 89/6.5
6,216,595 B1 * 4/2001 Lamorlette et al. ..... 102/270
6,484,115 B1 * 11/2002 Freymond et al. ..... 702/41
6,823,767 B2 * 11/2004 Vornfett et al. ..... 89/6.5
6,860,206 B1 * 3/2005 Rudakevych et al. ..... 102/206
(Continued)

*Primary Examiner* — Michael Carone
*Assistant Examiner* — Jonathan C Weber
(74) *Attorney, Agent, or Firm* — TraskBritt

(57) ABSTRACT

Microcontroller apparatuses and methods of use are disclosed. An explosive projectile system contains a faze and a remote fuze setter. The fuze includes a microcontroller comprising an RC-based clock generator and is configured to sample an accurate timing event sent from a crystal-based or similarly accurate timing device. The microcontroller is then calibrated with the received timing event and results are employed in a manner appropriate for desired implementation. Implementations of the microcontroller may include sampling a detonation delay value, in the form of a time pulse, and calibrating the microcontroller to issue a fire command at delay time after an impact event. Additionally, in a setter calibration application, a microcontroller may receive a carrier signal, calibrate the faze to an accurate time base and then set frequency boundary limits for subsequent data bit transfers.

28 Claims, 8 Drawing Sheets

U.S. PATENT DOCUMENTS

| | | | | |
|---|---|---|---|---|
| 7,124,689 | B2 * | 10/2006 | Davis et al. | 102/216 |
| 7,143,696 | B2 * | 12/2006 | Rudakevych et al. | 102/215 |
| 2003/0136250 | A1 * | 7/2003 | Vornfett et al. | 89/6.5 |
| 2005/0126379 | A1 * | 6/2005 | Pikus et al. | 89/6 |
| 2006/0037508 | A1 * | 2/2006 | Rudakevych et al. | 102/206 |
| 2007/0119326 | A1 * | 5/2007 | Rudakevych et al. | 102/206 |

* cited by examiner

METHOD AND APPARATUS FOR MUNITION TIMING AND MUNITIONS INCORPORATING SAME

FIELD OF THE INVENTION

Embodiments of this invention relate generally to fuzes for explosive devices and, more specifically, to apparatuses and methods for improved timing used in a controlled warhead initiation application or a setter calibration application.

BACKGROUND OF THE INVENTION

State of the Art

Explosive projectiles must be capable of detonating at the proper time for maximum desired effect in destroying a target. Depending on the application, the proper time may be before impact, at a specific point during flight, during impact, or at some time delay after impact. To control the detonation time and, in some instances to determine that time, these explosive projectiles are frequently equipped with fuzes. Fuzes are commonly configured with the capability of receiving external information from a remote setter located outside the projectile. As used herein, the terms "warhead," "explosive device," and "explosive projectile" are generally used to refer to a variety of projectile type explosives, such as, for example, artillery shells, rockets, bombs, and other weapon warheads. In addition, these explosive projectiles may be launched from a variety of platforms, including, for example, fixed wing aircraft, rotary wing aircraft (e.g., helicopters), ground vehicles, and stationary ground locations.

Conventionally, a fuze may be used to activate the explosive projectile for detonation in the vicinity of the target. In addition, the faze maintains the explosive projectile in a safe condition during logistical and operational phases prior to launch and during the first phase of the launch until the explosive projectile has reached a safe distance from the point of launch. In summary, significant functions that a faze performs include keeping the weapon safe during handling and prelaunch transport, arming the weapon when it is a safe distance from the point of launch, controlling time to detonation of the warhead and/or detecting the target, and initiating detonation of the warhead at some definable point after target detection.

The first two functions performed by a fuze, which include keeping the weapon safe and arming the weapon are conventionally referred to as Safing and Arming (S&A). Safing and Arming devices isolate a detonator from a booster charge of the warhead used to initiate detonation of the primary explosive until the explosive projectile has been launched and a safe distance from the launch vehicle is achieved. At that point, the S&A device removes a physical barrier from, or moves the detonator in line with, the explosive train. In doing so, the S&A device effectively arms the warhead so that it can initiate detonation at the appropriate time.

The other two functions performed by a fuze, which include detecting the target and initiating detonation, may depend on target type, explosive projectile type, and tactical operational decisions. Target detection may occur using sensors to detect proximity to a target, or using sensors to detect impact with a target. Explosives of other projectiles may be detonated without regard to target detection, using a simple timing device. Still other projectiles may use a timer to activate sensors for proximity and/or impact at an appropriate time. Conventionally, impact fuzes, as opposed to proximity fazes, are designed to detect the target by sensing one or more impacts or contacts with a target.

In an impact fuze, the final function of a fuze, initiating detonation of the warhead, may occur as temporally close to impact as possible or may be delayed for a certain period of time allowing the warhead to penetrate the target prior to detonation. Traditionally, delayed detonation has been performed by defining a fixed delay after impact to initiate detonation. Conventional fuze timing devices using a fixed delay may use RC or crystal-based timing devices. Although RC-based devices are robust during setback accelerations and impact decelerations, they are inherently inaccurate. Conversely, crystal-based timing devices are far more accurate but lack durability and require more components, thus resulting in an overall increase in implementation costs.

There is a need for methods and apparatuses that provide increased accuracy of fuze timing while providing a high level of strength for post-setback and impact munition functionality. Specifically, there is a need for an inexpensive, impact resistant timing device that can maintain a high level of accuracy.

BRIEF SUMMARY OF THE INVENTION

An embodiment of the present invention includes an RC timing apparatus for use within an explosive projectile. The RC timing apparatus comprises a fuze that includes a microcontroller comprising an RC-based clock generator. The microcontroller is configured for receiving a timing event from an accurate external time-based source, wherein the timing event has a time duration between a first timing edge and a second timing edge. The microcontroller is also configured for calibrating an internal timing loop of the microcontroller with the timing event.

Another embodiment of the present invention includes an explosive projectile system comprising an accurate time-based source, an encasement, and an explosive material disposed within the encasement and configured for detonation. The explosive projectile also includes a fuze disposed within the encasement and operably associated with the explosive material. The fuze comprises a housing and an RC timing apparatus disposed within the housing. The RC timing apparatus comprises a microcontroller, which includes an RC-based clock generator and is configured for receiving a timing event from an accurate internal time-based source, wherein the timing event has a time duration between a first timing edge and a second timing edge. The microcontroller is also configured for calibrating an internal timing loop of the microcontroller with the timing event.

Another embodiment of the present invention comprises a method of using an RC timing apparatus within an explosive projectile. The method comprises receiving a timing event from an accurate time-based source, wherein the timing event has a time duration between a first timing edge and a second timing edge. The method further includes calibrating an internal timing loop of a microcontroller with the time duration.

DETAILED DESCRIPTION OF THE INVENTION

The present invention provides apparatuses and methods of operation for an RC timing device to address accuracy issues concerning conventional RC timing devices and durability issues regarding conventional crystal-based timing devices.

In the following description, circuits and functions may be shown in block diagram form in order not to obscure the present invention in unnecessary detail. Conversely, specific circuit implementations shown and described are examples only and should not be construed as the only way to implement the present invention unless specified otherwise herein. Additionally, block definitions and partitioning of logic between various blocks is exemplary of a specific implementation. It will be readily apparent to one of ordinary skill in the art that the present invention may be practiced by numerous other partitioning solutions. For the most part, details concerning timing considerations and the like have been omitted where such details are not necessary to obtain a complete understanding of the present invention and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

The terms "assert" and "negate" are used respectively when referring to the rendering of a signal, status bit, or similar apparatus into its logically true or logically false state. Accordingly, if a logic level one or a high voltage represents an asserted state (i.e., logically true), a logic level zero or a low voltage represents the negated state (i.e., logically false). Conversely, if a logic level zero or a low voltage represents the asserted state, a logic level one or a high voltage represents the negated state.

In describing embodiments of the present invention, the systems and elements surrounding the invention are first described to better understand the function of embodiments of the invention as it may be implemented within these systems and elements.

Figure 1:
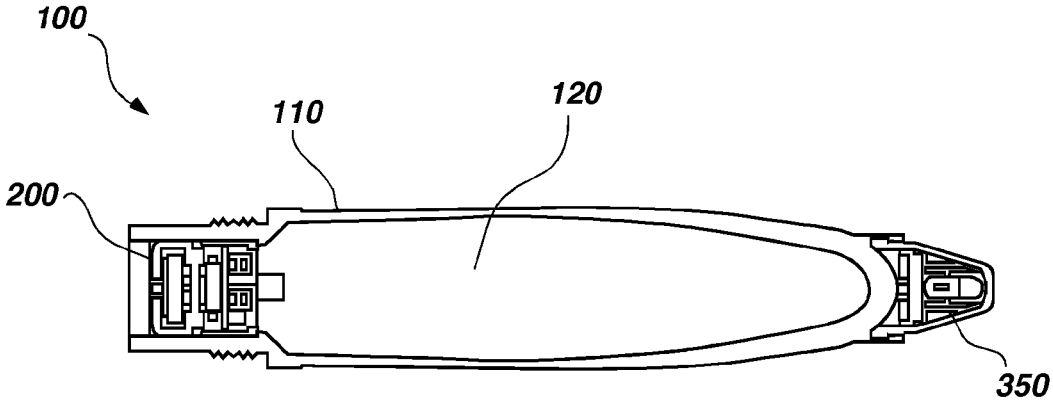
FIG. 1 is a diagram of an explosive projectile incorporating an embodiment of the present invention.

FIG. 1 illustrates an embodiment of an explosive projectile 100 (also referred to as a warhead). As illustrated in FIG. 1, the explosive projectile 100 includes a fuze 200 and an explosive material 120 encased by a housing 110. Additionally, the nose may include one or more impact sensors 350, such as, for example, a crush sensor, and a graze sensor. Also, as illustrated in FIG. 1, the explosive projectile 100 is configured at its aft end to be secured to a rocket motor, including an optional guidance section, although the invention is in no way limited to rocket-propelled projectiles.

Figure 2:
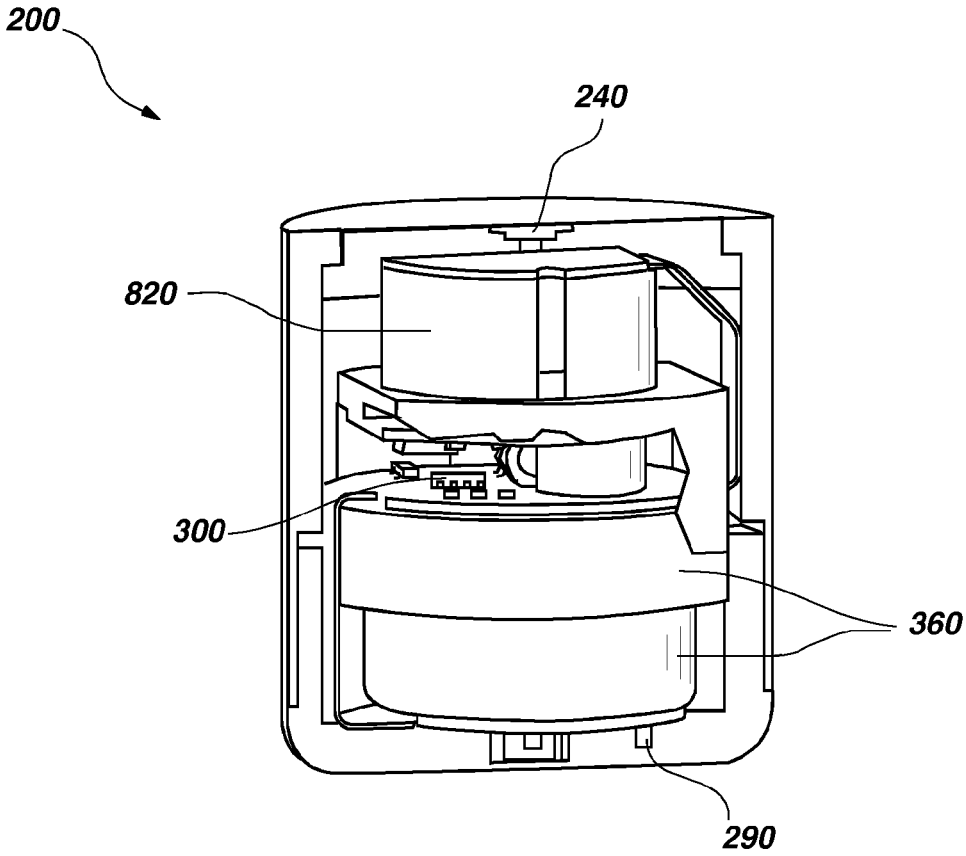
FIG. 2 is a cut-away perspective view of a fuze incorporating an embodiment of the present invention.

FIG. 2 illustrates an embodiment of a fuze 200. The functional elements within the fuze 200 may include a lead charge 240, a warhead initiation module 820, a communication interface 290, an electronics module 300, and a spin sensor 360. In FIG. 1, the fuze 200 is mounted in the aft end of the explosive projectile 100. The aft location places the fuze 200 within the "buried" warhead section adjacent to the rocket motor/guidance section, which is a relatively ineffective location for fragmentation and is well suited for the fuze 200. In addition, this location prevents the fuze 200 from interfering with forward fragmentation and allows an unobstructed forward target view for other sensors, such as, for example, proximity sensors. However, while the aft location is used in FIG. 1, other locations and configurations for fuzes are within the scope of the invention.

Figure 3:
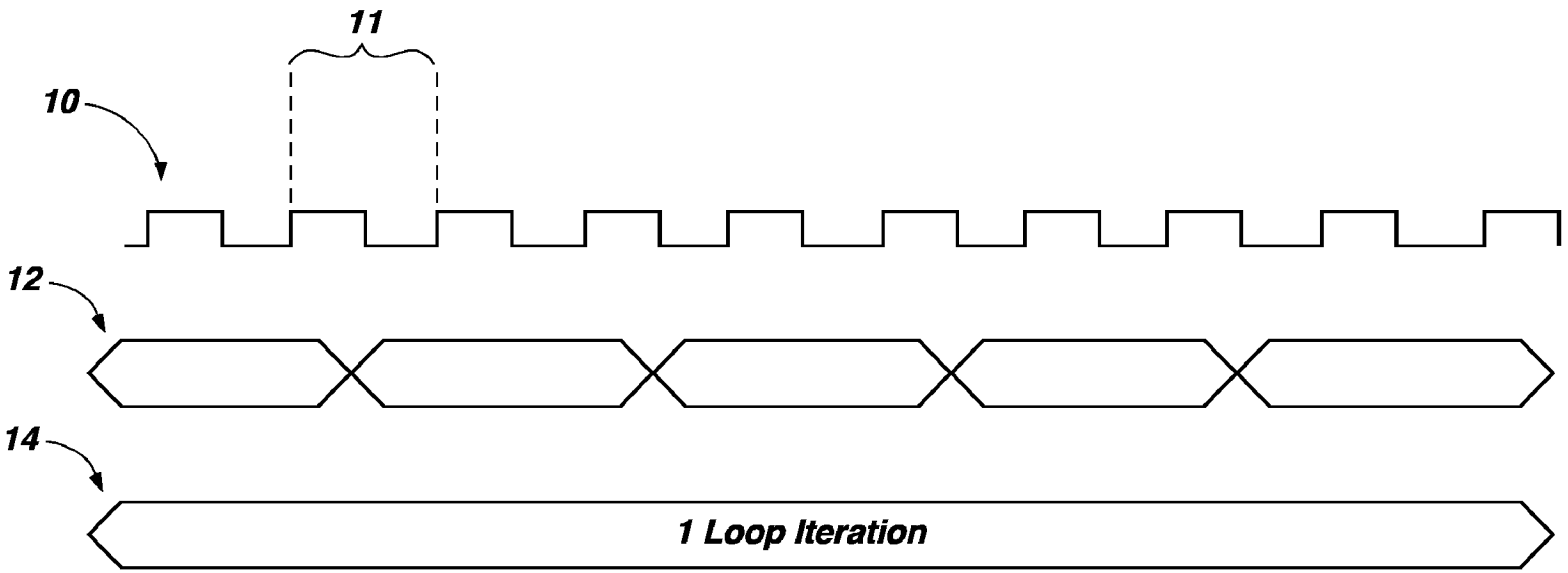
FIG. 3 illustrates a waveform of a generated clock signal, and representations of instructions and an internal loop iteration performed by a microcontroller in accordance with an embodiment of the present invention.

Warhead initiation module (WIM) 820 may include a microcontroller (not shown) that includes an RC-based clock generator. Referring to FIG. 3, an RC-based clock generator within the microcontroller may be configured to generate a clock signal 10 with a clock period 11, wherein resistor and capacitor values of the RC-based clock generator determine the frequency of the clock signal 10. Also included in microcontroller is an embedded software program that may be used to generate an internal timing loop. A certain number of instructions 12 or clock cycles 10 may occur during one loop iteration 14 of the internal timing loop. By way of example only, and not limitation, as depicted in FIG. 3, ten clock cycles 10 or five instructions 12 occur during one loop iteration 14.

Implementations of the microcontroller may include, but are not limited to, a setter calibration or a detonation delay application. In both implementations, the microcontroller is capable of sampling a timing event and employing results in a manner appropriate for the intended function. In the case of a setter calibration application, the timing event may consist of an oscillating carrier signal, while in the case of a detonation delay application, the timing event may be a single, accurate time pulse. By way of example only, the calibration process of both implementations will be described with values assigned for ease of description, and by no means do these assigned values limit any embodiment of the invention.

Figure 4:
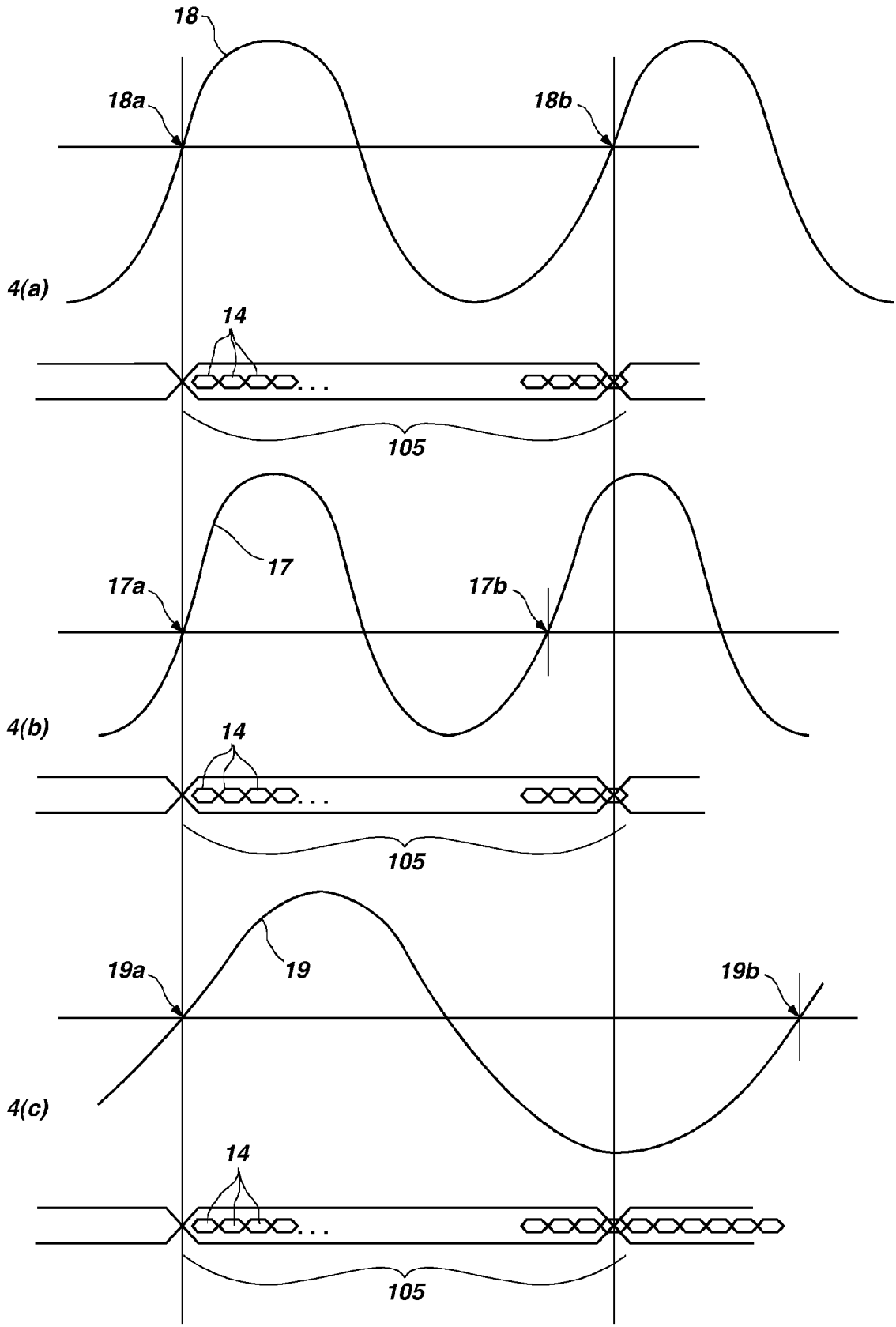
FIG. 4 is a representation of a measurement of an oscillating carrier signal in accordance with an embodiment of the present invention.
Figure 5:
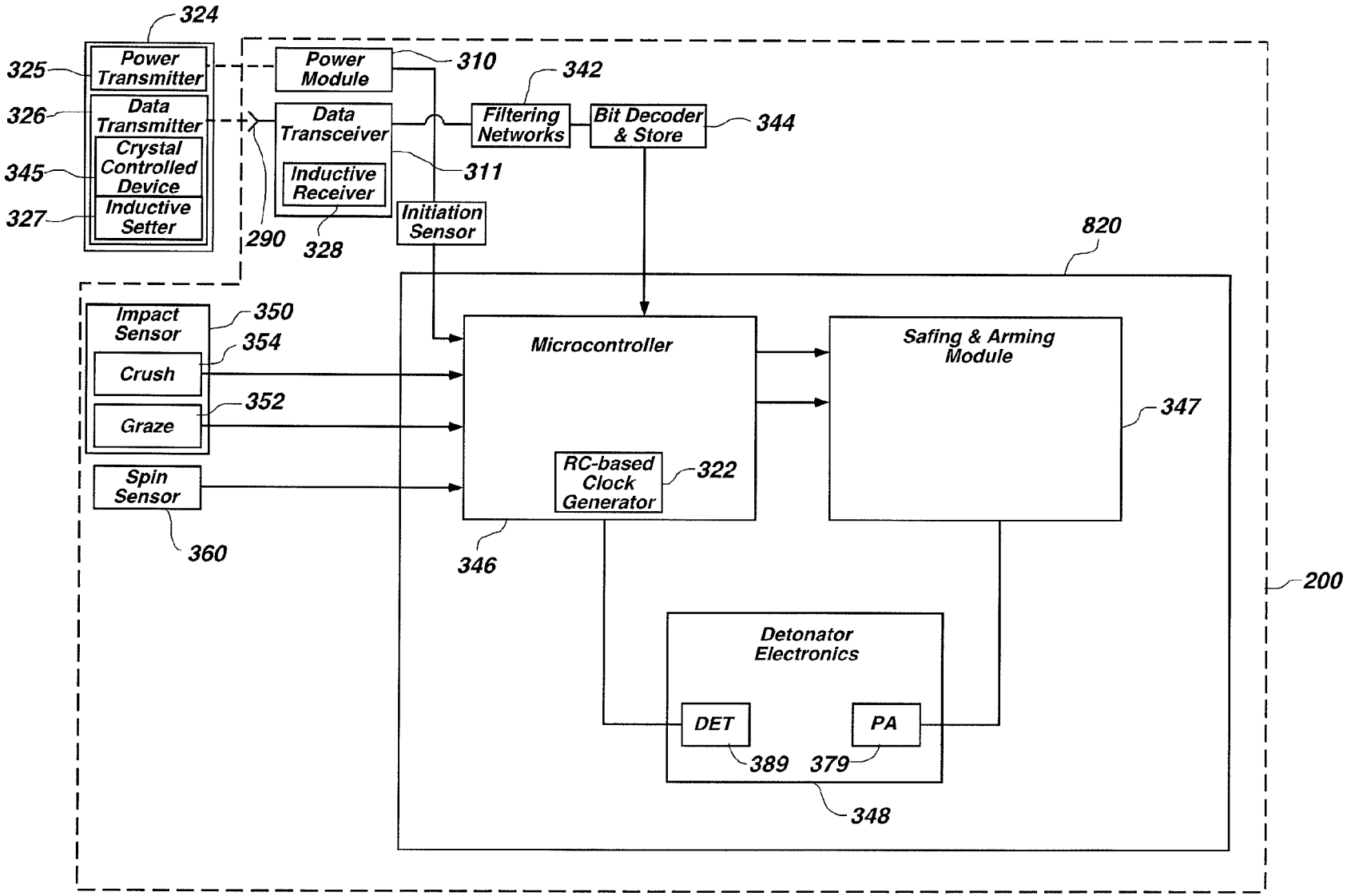
FIG. 5 is a block diagram of a setter calibration apparatus in accordance with an embodiment of the present invention.

FIGS. 3-5 illustrate a setter calibration implementation of an RC-based microcontroller according to an embodiment of the present invention. In the setter calibration application of the invention, the microcontroller may be configured to receive a timing event comprising a carrier signal 18. The microcontroller may then be calibrated by phase-locking an internal timing loop to the carrier signal frequency. Referring to FIGS. 3 and 4, if the clock signal 10 generated by the RC-based clock generator has a frequency of 10.5 MHz, the clock period 11 would be 0.095 μs. Since one loop iteration 14 of the internal sampling loop takes ten clock cycles, one loop iteration has a time period of 0.9523809524 μs.

If the microcontroller receives a carrier signal 18 with a frequency of 10 KHz, the microcontroller phase-locks the internal sampling loop by determining how many loop iterations can be completed during a time period from first leading edge 18*a* to a second leading edge 15*b* of carrier signal 18. The internal timing loop will start at the first leading edge 18*a* and will iterate through the loop until the second leading edge 18*b* of carrier signal 18 is located. In this case, because the time period of the carrier signal is equal to 0.1 ms, the second leading edge 15*b* will be located after one hundred and five (105) loop iterations. Therefore, once the internal sampling loop is phase-locked to the carrier signal frequency, the 10

KHz frequency is represented by 106 loop iterations. Because the 10 KHz frequency is represented by completed loop iterations, a small error may exist if the second leading edge 18*b* is present earlier in the loop iteration. In other words, if the second leading edge 15*b* is present after one hundred four and one-half loop iterations (104.5), the second leading edge 15*b* will not be located until one hundred and five (105) loop iterations have been completed. Consequently, the accuracy of the calibration may be off by no more than a complete iteration. In order to increase the accuracy, one complete loop iteration can be completed in less time by increasing the clock frequency or shortening the internal sampling loop.

With a calibrated time base, the microcontroller can set frequency boundary limits for subsequent data bit transfers to a projectile fuze using a frequency shift keying communication protocol. For example, future signals sent to the microcontroller on the carrier signal may be referenced to the 10 KHz time base. Signals with frequencies more than 10 KHz may be represented by digital 1s and signals with a frequencies less than 10 KHz may be represented by digital 0s. FIG. 4(*b*) illustrates a carrier signal 17 with a frequency that is higher than the frequency of carrier signal 18. With a higher frequency, the internal sampling loop will iterate less than 105 times from the first leading edge 17*a* to the second leading edge 17*b* of carrier signal 17. As a result, carrier signal 17 will be assigned a digital value of 1. FIG. 4(*c*) illustrates a carrier signal 19 with a frequency that is lower than the frequency of carrier signal 18. With a lower frequency, the internal sampling loop will iterate more than 105 times from the first leading edge 19*a* to the second leading edge 19*b* of carrier signal 19. As a result, carrier signal 19 will be assigned a digital value of 0.

FIG. 5 is a block diagram of a fuze 200 and a remote fuze setter 324 with an implementation of a setter calibration. The fuze 200 comprises a WIM 820, communication interface 290, power module 310, and data transceiver 311. WIM 820 includes microcontroller 346, an S&A module 347, and detonator electronics 348. Detonator electronics 348 includes a detonation actuator (DET) 389, and a piston actuator (PA) 379. Depending on the size of the explosive projectile 100 (FIG. 1), the amount of power available and the complexity of the fuze processing, fuze 200 may or may not include a main logic controller (not shown) in addition to microcontroller 346. In the setter calibration application shown in FIG. 5, microcontroller 346 serves as the controller for both the fuze electronics and the WIM 820; thus, a main controller is not needed. Fuze 200 may be configured to receive data signals transmitted from remote fuze setter 324 through the communication interface 290. Remote fuze setter 324 comprises power transmitter 325, data transmitter 326, and crystal controlled device 345.

Filtering networks 342 and bit decode and store device 344 extract the fuze setting parameters sent to the fuze 200 from data transmitter 326. Subsequently, the transmitted data is passed to the microcontroller 346. In some embodiments, filtering networks 342 and bit decode and store devices 344 may be incorporated into data transceiver 311. Microcontroller 346 includes an RC-based clock generator 322 and is configured to receive a carrier signal from crystal controlled device 345. Microcontroller 346 may use an embedded software program to self-adjust an internal sampling loop until the sampling loop is phase-locked to the frequency of the received carrier signal. As described above, microcontroller 346 measures a number of completed iterations of an internal timing loop during a timing measurement from a leading edge to a next leading edge of the carrier signal. The sampling loop is then phase-locked by representing the carrier signal frequency by the number of completed iterations. Frequency boundary limits can then be set for subsequent data bit transfers to the fuze 200.

The operation of the apparatus depicted in FIG. 5 will now be described. After fuze 200 is powered up, as indicated by initiation sensor 390, microcontroller 346 may receive a carrier signal from crystal controlled device 345, transmitted from inductive setter 327 to inductive receiver 328. Microcontroller 346 adjusts an internal sampling loop until the loop is phase-locked to the carrier signal frequency. Hereafter, fuze 200 is calibrated with an accurate time base and is capable of monitoring timing events with greater precision. For example, with a calibrated 10 KHz time base, fuze 200 is able to more accurately sample an angular displacement sensor (not shown) or determine a fuze spin rate of spin sensor 360. Calibration of fuze 200 may occur during a pre-flight period before the projectile is launched and a carrier signal may be generated by a crystal-based or similarly accurate timing device located in remote fuze setter 324.

Figure 6:
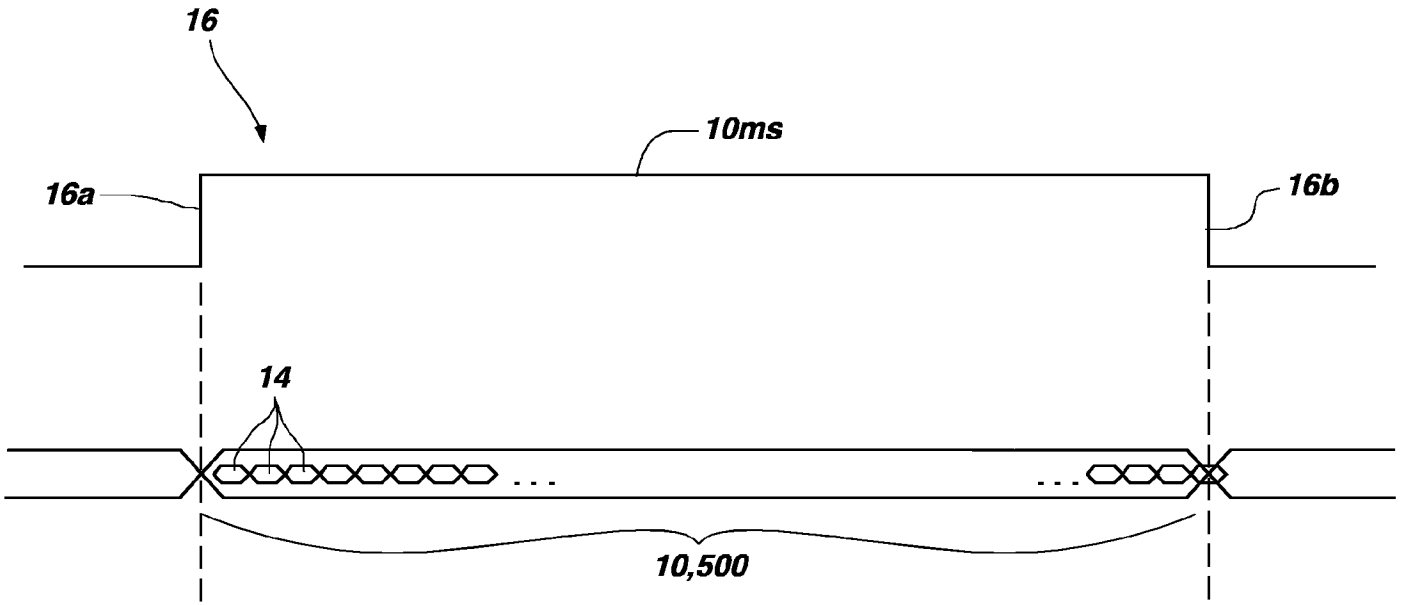
FIG. 6 is a representation of a measurement of a time pulse in accordance with an embodiment of the present invention.

FIGS. 3 and 6-9 illustrate a detonation delay application of an RC-based microcontroller according to an embodiment of the present invention. In the detonation delay application, the microcontroller may be configured to receive a timing event comprising a time pulse 16. Calibration of the microcontroller may then take place by determining the number of completed iterations through an internal timing loop for the duration of the received timing event. Referring to FIGS. 3 and 6, if the clock signal 10 generated by the RC-based clock generator has a frequency of 10.5 MHz, the clock period 11 would be 0.095 μs. Since one loop iteration 14 takes ten clock cycles, one loop iteration 14 has a time period of 0.9523809524 μs. The internal timing loop will start at the leading edge 16*a* and will iterate through the loop until the trailing edge 16*b* of time pulse 16 is located. In this case, because the period of the time pulse is equal to 10 ms, the trailing edge 16*b* will be located after 10,500 loop iterations. The microcontroller may then store this measured loop iteration as a detonation delay, as discussed below.

In a delayed point detonation (PD) mode, which may be selected by a user prior to launch, the explosive projectile 100 is triggered to detonate at a fixed time period after impact (detonation delay). As part of the fixed delay after impact, various delays may be used from "super quick," or almost instantaneous, to any desired delay value. This fixed delay may be pre-programmed in the firmware of fuze 200, possibly based on target lethality studies.

Figure 7:
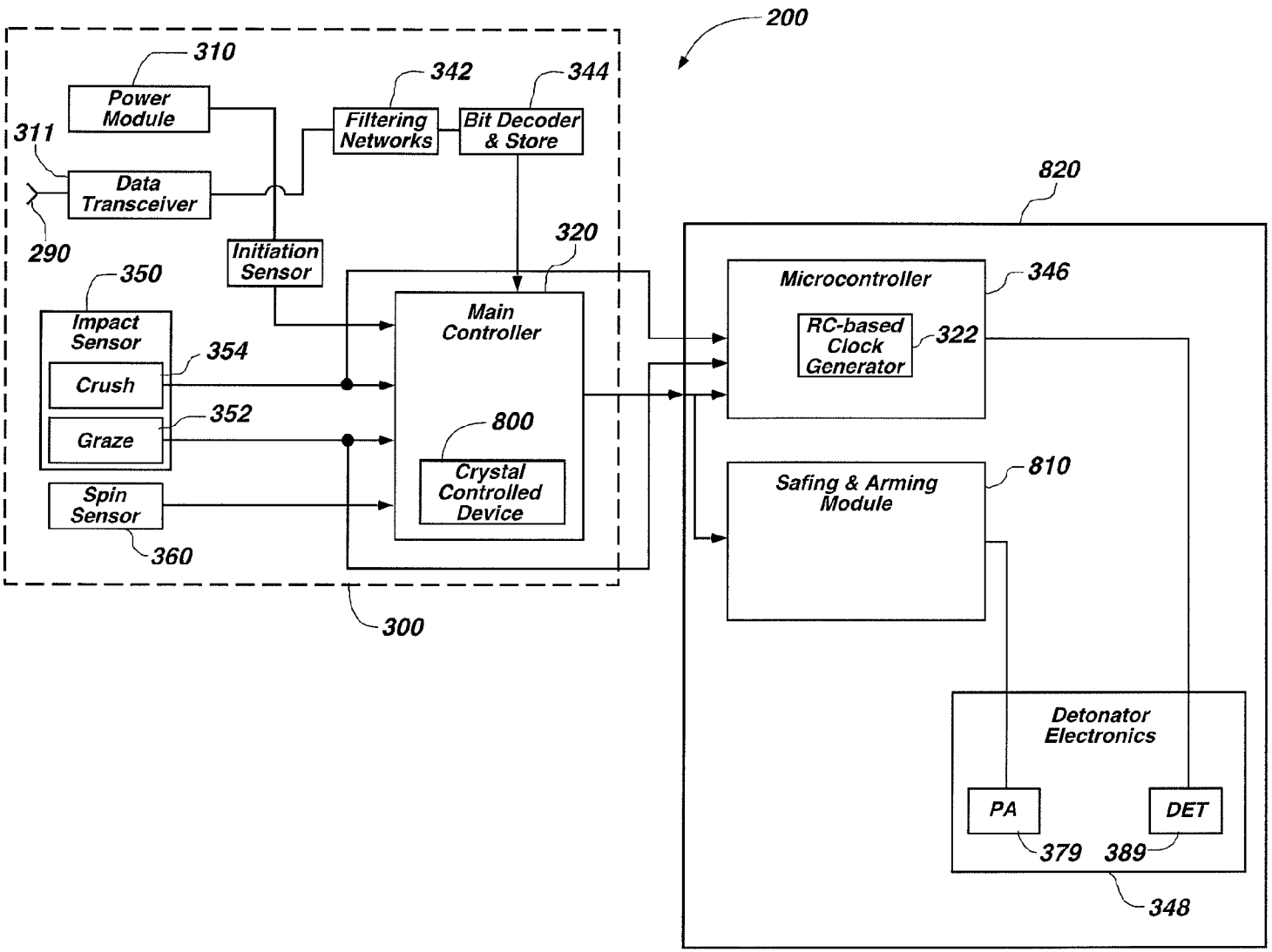
FIG. 7 is a block diagram of a detonation control apparatus in accordance with an embodiment of the present invention.

FIG. 7 is a block diagram of fuze 200 with implementation of a detonation time delay using a delayed PD mode. To implement the delayed PD mode with a user-defined detonation delay value, fuze 200 may include a microcontroller 346 within WIM 820, used in conjunction with a main controller 320. Microcontroller 346 includes an RC-based clock generator 322 and is configured to receive a timing event, in the form of a time pulse, from a crystal controlled device 800 located within main controller 320 within fuze electronics 300. In operation, during a pre-flight period, flight information including a desired detonation mode, detonation time delay and target and arming data may be sent by a user to the main controller 320 via communication interface 290. Main controller 320 may store the flight data, in non-volatile memory, for future reference.

During projectile flight, main controller 320 may power up under its own power, as indicated by initiation sensor 340, and make flight decisions including sending the detonation delay value, in the form of a time pulse, to the microcontroller 346. By way of example, and not limitation, if a user desires a 10 ms detonation delay, data including the desired 10 ms detonation time delay may be sent to the main controller 320 before projectile launch. Subsequently, after projectile launch, a time pulse with a 10 ms width may be sent from the crystal controlled device 800 of the main controller 320 to the microcontroller 346. Microcontroller 346 samples the time pulse width and calibrates itself, as described above, by recording the number of completed iterations of an internal timing loop during a measurement from a leading edge to a trailing edge of the time pulse. After calibration, microcontroller 346 records the measurement as a detonation delay and stores the data for future reference. Upon sensing an impact of the explosive projectile 100 (FIG. 1), from impact sensor 350, main controller 320 may send an impact event (fire) signal to microcontroller 346. Or in another embodiment, microcontroller 346 may detect an impact directly from impact sensor 350. After receiving a fire signal, microcontroller 346 iterates through the same number of measured iterations as recorded during calibration and, upon completion, issues a fire command to the detonator electronics 348. As shown in the described embodiment of FIG. 7, crystal controlled device 800 is configured to send a time pulse during projectile flight. Consequently, crystal controlled device 800 is still susceptible to, and must survive, setback environments during launch. After crystal controlled device 800 has sent the time pulse during flight, it is no longer needed, and, therefore, crystal controlled device 800 is not required to survive a projectile impact.

Calibrating a microcontroller with an accurate timing event from an accurate timing source eliminates RC timing errors associated with conventional RC devices. Because the delay times and the sampling rates may be calibrated at the final real-time operating temperature and the final real-time power supply voltage, problems associated with operating temperature effects and power supply changes may be eliminated. Additionally, RC timing concerns regarding component variations may be eliminated while the microcontroller remains more shock resistant due to RC durability. Therefore, the microcontroller is robust during setback accelerations and impact decelerations and, at the same time maintains a high level of accuracy.

Figure 8:
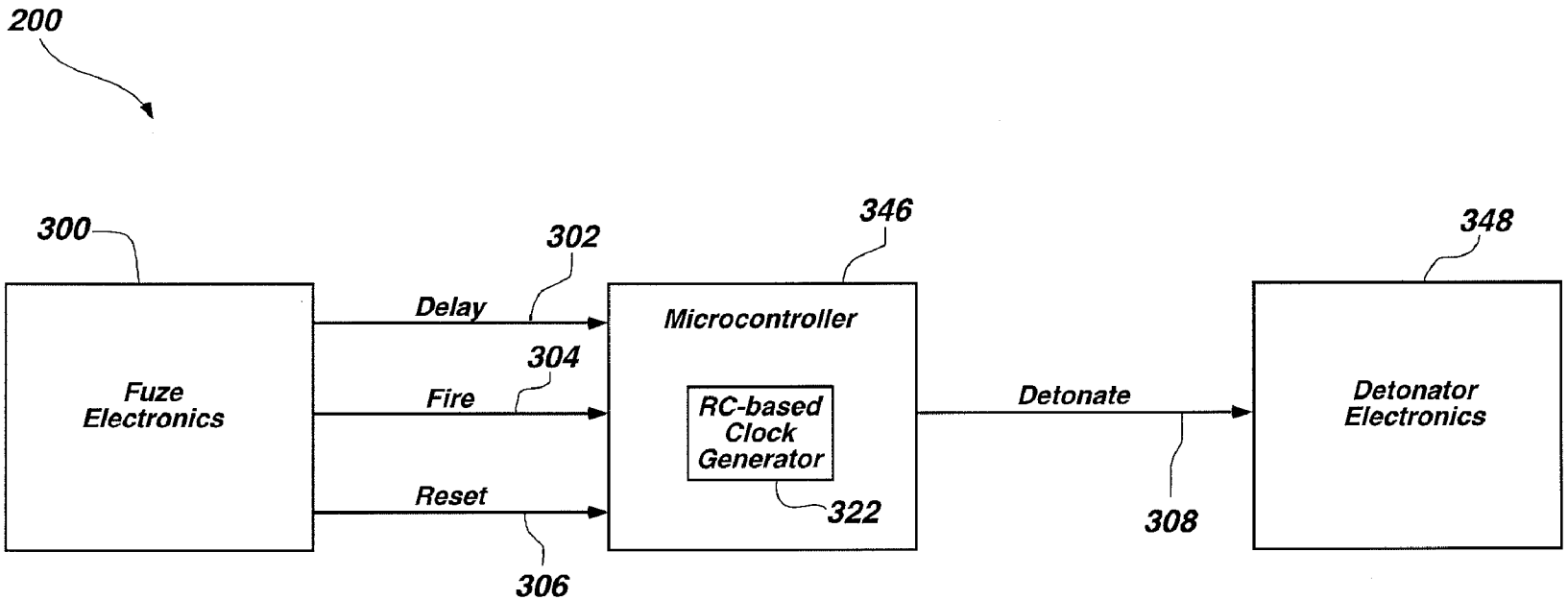
FIG. 8 is a simplified block diagram of a detonation control apparatus in accordance with an embodiment of the present invention.

FIG. 8 illustrates a simplified block diagram of fuze 200 with implementation of a detonation time delay using a PD mode. Fuze 200 comprises fuze electronics 300, microcontroller 346 and detonator electronics 348. During an in-flight period, fuze electronics 300 may send a time delay 302 in the form of a time pulse to microcontroller 346. As described above, upon receiving a time pulse, microcontroller 346 may calibrate an internal timing loop with the detonation time delay. Upon a sensed impact event, fuze electronics 300 may then send a fire command 304 to microcontroller 346. After receiving a fire command 304, microcontroller 346 duplicates the detonation delay amount by iterating through the recorded timing loop, and, upon completion, sends a detonate command 308 to detonator electronics 348. Additionally, fuze electronics 300 may be configured to include the capability of sending a reset command 306 to microcontroller 346 to reset any data and controller state stored therein.

Figure 9:
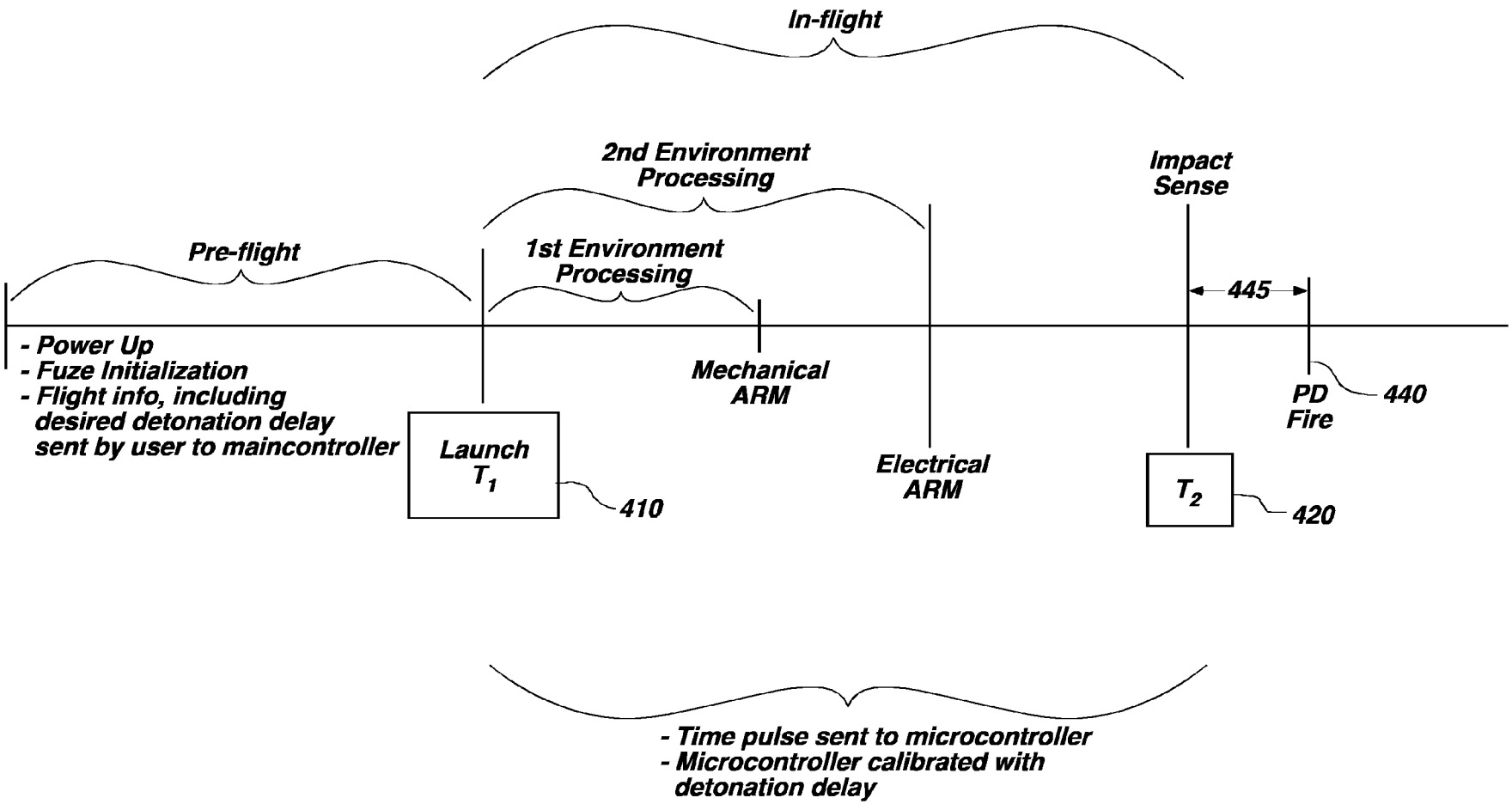
FIG. 9 is a time line diagram illustrating events of interest prior to detonation of an explosive projectile incorporating an embodiment of the present invention.

The timeline illustrated in FIG. 9, along with the block diagram in FIG. 7 may be used to describe an example of a detonation delay of explosive projectile 100 incorporating an embodiment of the invention. A potential launch may begin with the powering of the faze 200. Powering up the fuze 200 may cause the fuze 200 to perform self-checks and to determine the operating mode based on the content of the initializing settings. Additionally, at this time, or any time during the pre-flight period, a detonation delay value, including other relevant flight information, may be sent by a user to main controller 320 via the communication interface 290.

A launch may be triggered after completion of the initialization and message processes. The launch event (also referred to as the initiation event 410) is shown in FIG. 9 as $T_1$. As explained earlier, part of the S&A function is to prevent premature detonation. For example only, S&A may incorporate two independent environmental criteria to determine if the explosive projectile 100 (FIG. 1) may be safely armed. The first environmental criterion check determines if appropriate launch acceleration has been achieved. The second environmental criterion check determines if the explosive projectile 100 has achieved an acceptable spin profile. The launch event 410 triggers the first environmental criterion detection process and begins the second environmental criterion process. Upon completion of both environmental criteria, S&A module 810 fires piston actuator 379 (FIG. 7). Firing the piston actuator 379 performs the final alignment of explosive train and the explosive projectile 100 is armed for detonation. During the in-flight period, microcontroller 346 may receive a detonation delay amount, in the form of a time pulse, from crystal controlled device 800 and an internal timing loop may be calibrated with the detonation delay amount.

FIG. 9 shows the impact event 420 as $T_2$. For example, the graze sensor 352, the crush sensor 354 (FIG. 7), or a combination of the two sensors may detect impact. Once the impact event 420 has been determined, main controller 320 sends a fire command 304 to microcontroller 346 and microcontroller 346 iterates through the calibrated timing loop to reach the detonation delay amount 445. When the appropriate delay is reached, microcontroller 346 asserts a fire signal to detonation actuator 389. With both piston actuator 379 and detonation actuator 389 asserted, detonator electronics 348 triggers a detonation event 440 of the explosive projectile 100.

Although this invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A timing apparatus for use within an explosive projectile, comprising:

a fuze including a microcontroller comprising an RC-based clock generator and configured for:

receiving a timing event from an accurate time-based source, wherein the timing event has a time duration between a first timing edge and a second timing edge;

executing software instructions comprising repeatedly performing iterations of an internal timing loop of instructions, each internal timing loop comprising a loop period taking a predetermined number of instruction executions at an instruction execution rate set by the RC-based clock generator, wherein a first iteration begins at the first timing edge and a last iteration ends at or within the loop period corresponding to the second timing edge to determine an iteration value comprising a number of executions of the internal timing loop; and after the receiving the timing event, executing the internal timing loop the iteration value times to generate a calibrated time base correlated to the accurate time-based source.

2. The timing apparatus of claim 1, wherein the accurate time-based source is a crystal-based timing source.

3. The timing apparatus of claim 1, wherein the timing event comprises a time pulse.

4. The timing apparatus of claim 3, further comprising at least one controller operably connected to the microcontroller.

5. The timing apparatus of claim 4, wherein the microcontroller is further configured for:

sensing an impact event received from the at least one controller; and generating a detonation event after executing the internal timing loop a number of times equal to the iteration value after the impact event.

6. The timing apparatus of claim 3, further comprising at least one impact sensor operably connected to the microcontroller.

7. The timing apparatus of claim 6, wherein the microcontroller is further configured for:

sensing an impact event received from the at least one impact sensor; and generating a detonation event the calibrated time base after the impact event by executing the internal timing loop a number of times equal to the iteration value after the impact event.

8. The timing apparatus of claim 1, wherein the timing event comprises two consecutive same direction edges of an oscillating carrier signal.

9. The timing apparatus of claim 8, wherein the microcontroller is further configured for:

setting frequency boundary limits for the oscillating carrier signal;

repeatedly executing the internal timing loop the iteration value number of times to repeatedly generate the calibrated time base; and sampling the oscillating carrier signal such that a period of the oscillating carrier signal greater than the calibrated time base is assigned a first binary value and a period of the oscillating carrier signal less than the calibrated time base is assigned a second binary value.

10. The timing apparatus of claim 8, wherein the oscillating carrier signal has a frequency of substantially 10 KHz.

11. An explosive projectile, comprising:

an accurate time-based source;

an encasement;

an explosive material disposed within the encasement and configured for detonation; and a fuze operably associated with the explosive material, the fuze comprising:

a housing; and a timing apparatus disposed within the housing and comprising:

a microcontroller comprising an RC-based clock generator and configured for:

receiving a signal from the accurate time-based source, wherein the signal has an identifiable frequency and a timing event with a time duration between a first timing edge and a second timing edge;

executing software instructions comprising repeatedly performing iterations of an internal timing loop of instructions, each internal timing loop comprising a loop period taking a predetermined number of instruction executions at an instruction execution rate set by the RC-based clock generator;

measuring a number of iterations of the internal timing loop of instructions executed by the microcontroller during the time duration; and representing the identifiable frequency with a period of the identifiable frequency determined by executing the internal timing loop a number of times corresponding to the number of iterations.

12. The explosive projectile of claim 11, wherein the accurate time-based source is a crystal-based timing source.

13. The explosive projectile of claim 11, wherein the timing event comprises a time pulse.

14. The explosive projectile of claim 13, further comprising at least one controller operably connected to the microcontroller.

15. The explosive projectile of claim 14, wherein the microcontroller is further configured for:

sensing an impact event received from the at least one controller; and generating a detonation event by iterating through the internal timing loop a number of times equal to the measured number of iterations after the impact event.

16. The explosive projectile of claim 13, further comprising at least one impact sensor operably connected to the microcontroller.

17. The explosive projectile of claim 16, wherein the microcontroller is further configured for:

sensing an impact event received from the at least one impact sensor; and generating a detonation event by iterating through the internal timing loop a number of times equal to the measured number of iterations after the impact event.

18. The explosive projectile of claim 11, wherein the timing event comprises two consecutive same direction edges of an oscillating carrier signal.

19. The explosive projectile of claim 18, wherein the microcontroller is further configured for:

setting frequency boundary limits for the oscillating carrier signal;

repeatedly executing the internal timing loop the number of iterations times to generate the represented identifiable frequency; and sampling the oscillating carrier signal during a data phase such that a period of the oscillating carrier signal greater than a period of the represented identifiable frequency is assigned a first binary value and a period of the oscillating carrier signal less than the period of the represented identifiable frequency is assigned a second binary value.

20. The explosive projectile of claim 18, wherein the oscillating carrier signal has a frequency of substantially 10 KHz.

21. A method of using a timing apparatus within an explosive projectile, comprising:

receiving a timing event from an accurate time-based source, wherein the timing event has a time duration between a first timing edge and a second timing edge; and calibrating an internal timing loop of instructions executed by a microcontroller to represent the time duration as an iteration value indicative of a number of iterations of the internal timing loop during the time duration;

wherein the internal timing loop comprises software instructions configured for repeated execution and each execution of the internal timing loop comprises a loop period taking a predetermined number of instruction executions at an instruction execution rate set by an RC-based clock generator.

22. The method of claim 21, wherein receiving the timing event from the accurate time-based source comprises receiving the timing event from a crystal-based source.

23. The method of claim 21, wherein receiving the timing event from the accurate time-based source comprises receiving a time pulse from the accurate time-based source.

24. The method of claim 23, further comprising:

sensing an impact event received from at least one controller; and generating a detonation event after iterating through the internal timing loop a number of times equal to the iteration value after the impact event.

25. The method of claim 24, further comprising receiving a command indicating that the detonation event is to be generated in a point detonation mode.

26. The method of claim 21, wherein receiving the timing event from the accurate time-based source comprises receiving two consecutive same direction edges of an oscillating carrier signal from the accurate time-based source.

27. The method of claim 26, further comprising:

setting frequency boundary limits for the oscillating carrier signal;

repeatedly executing the internal timing loop for the number of iterations to repeatedly generate the represented time duration; and sampling the oscillating carrier signal such that a period of the oscillating carrier signal greater than the represented time duration is assigned a first binary value and a period of the oscillating carrier signal less than the represented time duration is assigned a second binary value.

28. The method of claim 26, wherein receiving the oscillating carrier signal comprises receiving the oscillating carrier signal with a frequency of substantially 10 KHz.

* * * * *

UNITED STATES PATENT AND TRADEMARK OFFICE

CERTIFICATE OF CORRECTION

PATENT NO. : 7,926,402 B2
APPLICATION NO. : 11/564714
DATED : April 19, 2011
INVENTOR(S) : Eugene C. Pikus and David P. Erdmann It is certified that error appears in the above-identified patent and that said Letters Patent is hereby corrected as shown below:

On the title page:

In ITEM (57) ABSTRACT (line 2): change “faze” to --fuze--
In ITEM (57) ABSTRACT (line 14): change “faze” to --fuze--

Signed and Sealed this
Sixth Day of August, 2013

Teresa Stanek Rea
*Acting Director of the United States Patent and Trademark Office*